United States Patent [19]

Ganno et al.

[11] Patent Number: 4,720,090

[45] Date of Patent: Jan. 19, 1988

[54] PROCESS AND AN APPARATUS FOR FOLDING AND PACKING HOSE

[75] Inventors: Yoshihiro Ganno; Toyomi Kuniki, both of Yamatotakada, Japan

[73] Assignees: Takatori Machinery Mfg. Co., Ltd.; Takatori Hitech Co., Ltd., both of Yamatotakada, Japan

[21] Appl. No.: 915,277

[22] Filed: Oct. 2, 1986

[30] Foreign Application Priority Data

May 16, 1986 [JP] Japan ..... 61-113100

[51] Int. Cl.[4] ..... B42C 1/00

[52] U.S. Cl. ..... 270/45; 223/1; 53/117

[58] Field of Search ..... 270/45; 53/206, 266 A, 53/236, 255, 117, 390; 493/183, 186, 386, 458, 922, 935, 938; 223/1

[56] References Cited

U.S. PATENT DOCUMENTS

| | | | |
|---|---|---|---|
| 2,789,815 | 4/1957 | Nash, Jr. et al. | 270/45 |
| 3,097,770 | 7/1963 | Garrou | 223/1 |
| 3,310,930 | 3/1967 | Korch et al. | 53/117 |
| 3,383,837 | 5/1968 | Grenot | 53/390 |
| 3,750,916 | 8/1973 | Stringer et al. | 53/117 |
| 4,379,384 | 4/1983 | Nishikawa | 53/117 |
| 4,543,768 | 10/1985 | Nishikawa | 53/117 |
| 4,678,173 | 7/1987 | Basinger et al. | 270/45 |

FOREIGN PATENT DOCUMENTS

| | | | |
|---|---|---|---|
| 759085 | 4/1971 | Belgium | 53/117 |
| 1226480 | 10/1966 | Fed. Rep. of Germany | 53/117 |
| 2805650 | 8/1979 | Fed. Rep. of Germany | 53/117 |
| 975808 | 11/1964 | United Kingdom | 53/117 |
| 148748 | 9/1961 | U.S.S.R. | 53/117 |

*Primary Examiner*—E. H. Eickholt

*Attorney, Agent, or Firm*—Wenderoth, Lind & Ponack

[57] ABSTRACT

This invention relates to a process and an apparatus for automatically folding long hose, wrapping them up in dressing paper and packing them into an envelope using dressing paper capable of being folded in three on two crease lines. A sheet of the dressing paper, fed on to the start position of a conveyor unfolded, is intermittently transferred at a constant interval firmly held by a suction belt; to begin with one third on one side of the dressing paper, to form the inner-flap part, is bent up during transfer; on its arrival at next stop, a pair of hose are put on the central part of the dressing paper, to form the back cover part; the inner-flap part is laid on the hose; one of the hose ends behind the other on the conveyor is laid on the inner-flap part. A weighting plate, after having pressed them together, moves forward in order to tense the hose, and pass through under a fixed plate on which the other hose end is placed, whereby the second hose end is put on the first one. The weighting plate goes backward, while the dressing paper goes forward, so as to get out between the overlapped hose ends; one third on the other side of the dressing paper, to form the front cover part, is bent up and laid on the hose so as to wrap up in the dressing paper and put in an envelope.

2 Claims, 23 Drawing Figures

(A)

(B)

(A)

(B)

(C)

(A)

(B)

(C)

PROCESS AND AN APPARATUS FOR FOLDING AND PACKING HOSE

This invention relates to a process and an apparatus for folding and packing comparatively long hose, such as knee socks, seamless stockings or pantyhose; more specifically, it relates to a process and an apparatus for automatically accomplishing every operation from feeding dressing paper through wrapping folded hose in the dressing paper to packing them into an envelope using dressing paper capable of being folded in three on crease lines previously provided.

Since hose are generally very soft and pliant, good care has to be taken for their packing so as not to leave slackening in the package. For this, they are folded on cardboard so as to cover up, which is further wrapped in dressing paper like leaflet on which tradenames or advertisement are printed. In the case that no cardboard is used, they are folded and put in a sheet of dressing paper capable of being folded in three and then packed into a transparent plastic envelope, which is folded by the mouth on which a piece of adhesive tape is applied for sealing. At present, in view of rationalization of the packing process and saving of the packing material, the latter system, using the triple-folding dressing paper, is applied to major part of the hose package due to the fact that the employment of the triple-folding dressing paper can make do without cardboard, and, accordingly, without the feeding process thereof.

For all that, the above hose packing process still requires making every step separately one by one, so that the process tends to be intricate and the number of steps cannot help increasing in consequence thereof.

On account of this, there have so far been proposed various proposals for automatically folding and packing hose to overcome the above mentioned difficulties; nevertheless, their embodiment always follows utmost hardness and trouble because hose are very pliant objects as stated above. For example, in some proposals hose are conveyed over the intire process pushed behind; accordingly, they are apt to get out of the prescribed position, with the result that there are required additional means for adjustment, which inevitably lessens reliability on the movement of parts and makes the structure of the apparatus very complex in the end. The situation being such that the fact is that any practical benefit has not been given by the precedent proposals yet.

Accordingly, it is an object of this invention to provide a process for very efficient folding and packing hose using dressing paper capable of being folded in three in an automatic fashion. It is another object of this invention to provide an apparatus for folding and packing hose with very reliable performance and simple structure which can carry out the folding and packing of finished hose in an automatic fashion. The above and other objects and features of this invention will appear more fully hereinafter from a consideration of the following description taken in connection with the accompanying drawing wherein one example is illustrated by way of example.

Figure 4:
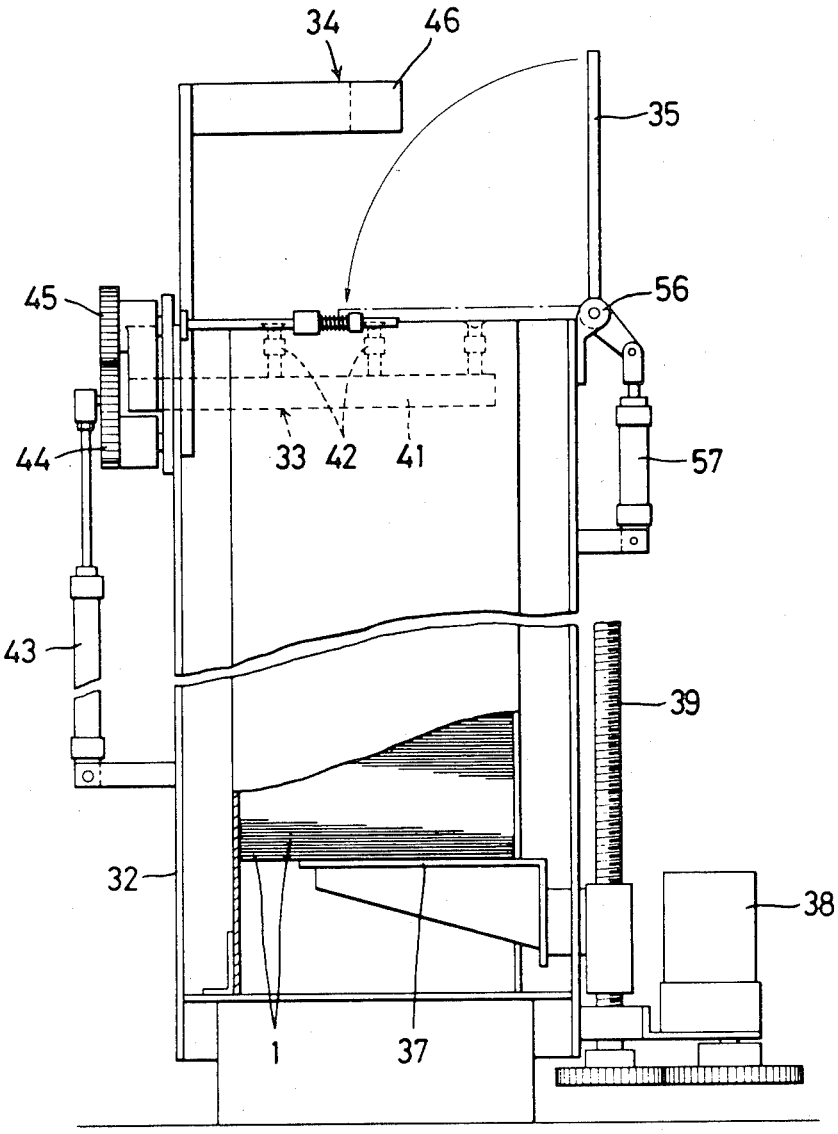
FIG. 4 is an elevational view of the apparatus seen along the arrow-headed direction B in FIG. 1.
Figure 15:
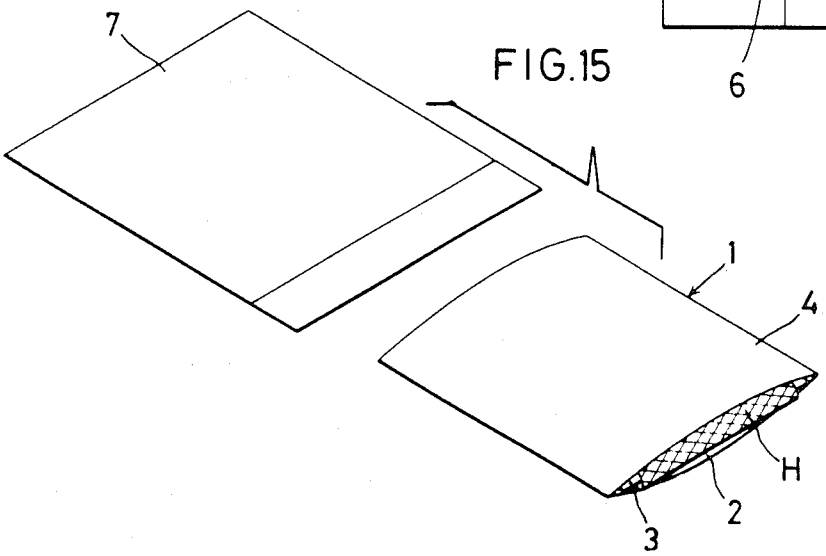
FIG. 15 is a perspective view of the dressing paper that wraps up the hose and an envelope for packing the whole of the dressing paper and the hose.

As shown in FIG. 4, a sheet of dressing paper 1 used in the wrapping process and apparatus of this invention consists of three parts: back cover part 2 in the middle, inner-flap part 3 on one side and front cover part 4 on the other, which are bounded by two crease lies 5, 6 previously provided, so that the dressing paper 1 can be folded in three. As shown in FIG. 15, when a pair of hose H is put on the back cover part 2 of the dressing paper, firstly, the inner-flap part 3 is folded and laid on the hose H; secondly, each of the hose ends $H_1$, $H_2$ is folded on the inner-flap part 3 one after another; thirdly, the front cover part 4 is folded on them so as to cover their whole part; and finally, the hose H wrapped up in the dressing paper 1 are put in an envelope 7.

Figure 1:
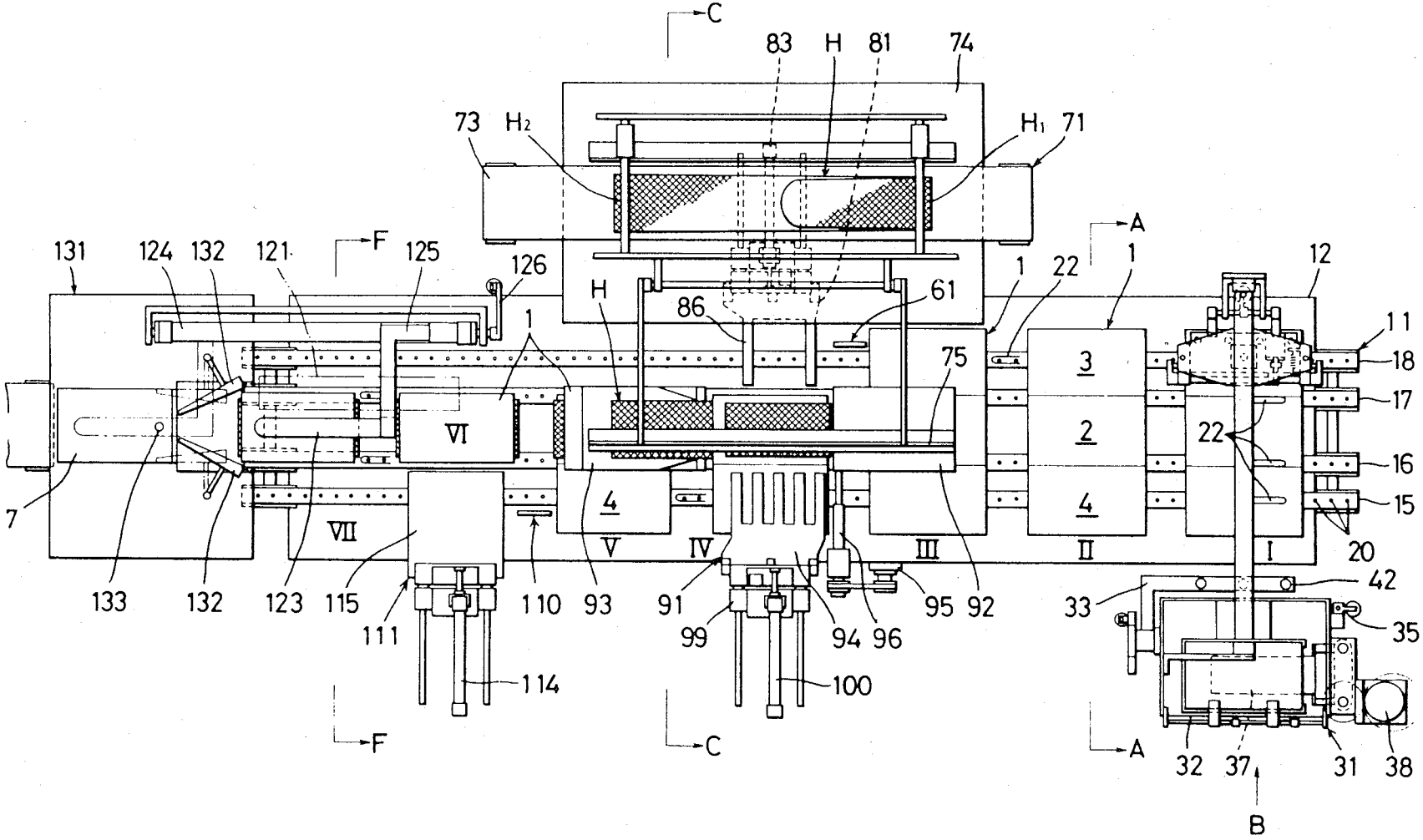
FIG. 1 is a whole plan view of a hose-folding and -packing apparatus of this invention.
Figure 2:
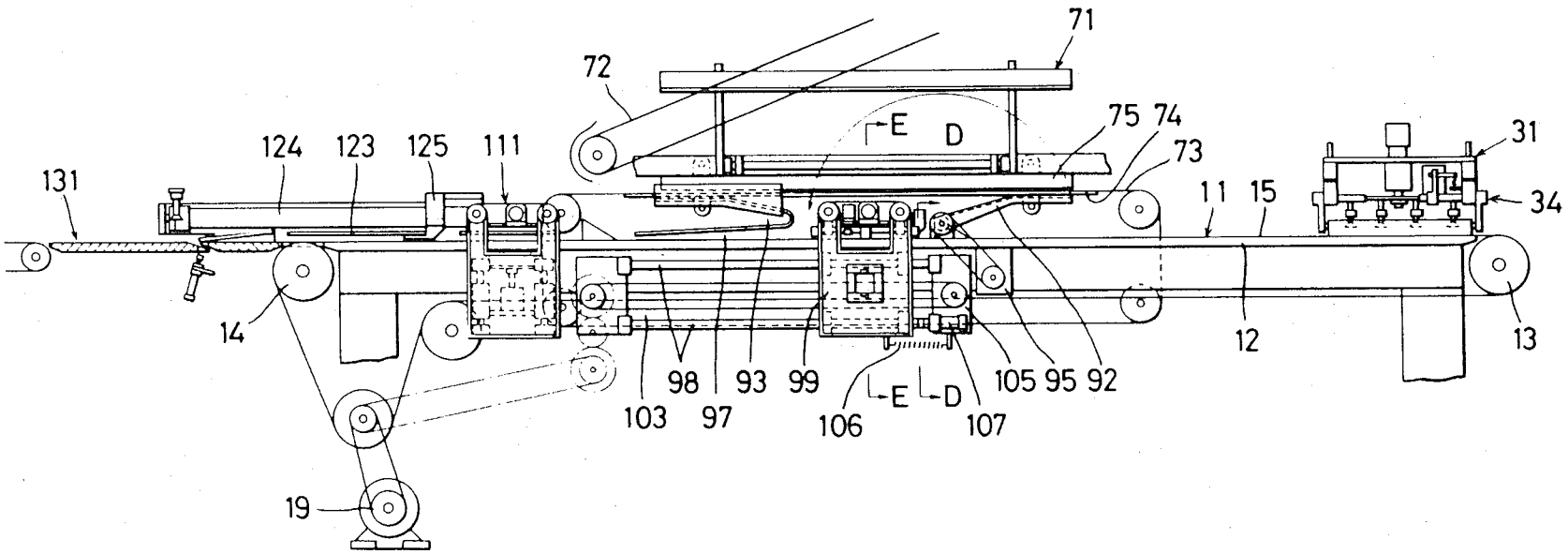
FIG. 2 is a partially omitted elevational view of the apparatus in FIG. 1.

As shown in FIGS. 1 and 2, an apparatus of this invention for folding and packing hose is constructed substantially of a conveyor 11, which forwards the dressing paper at an intermittent, constant rate from the position I to VI firmly holding by suction; a dressing paper-feeding apparatus 31, which is provided beside the position I to feed the dressing paper thereon in the developed condition one by one; a first dressing paper-bending up member 61, which is provided to bend up the inner-flap 3 by a given angle to the horizontal plane between the position III and IV; a hose-feeding apparatus 71, which is provided to put a pair of yet unfolded hose H on the back cover part 2 of the dressing paper staying on the position IV; a first dressing paper-folding member 81, which is provided to lay the inner-flap part 3 of the dressing paper on top of the unfolded hose; a hose-folding member 91, which lays both the hose ends $H_1$, $H_2$, extending out of the in er-flap part 3, on the inner-flap part 3; a second dressing paper-bending up member 110, which is provided to bend up the front cover part 4 by a given angle to the horizontal plane, a second dressing paper-folding member 111, which lays the front cover part 4 on the folded hose H, and a packing apparatus 131, which puts the hose H, wrapped up in the dressing paper, in the envelope 7.

The conveyor 11 is provided with four parallel endless belts 15, 16, 17, 18, kept properly tensed and horizontally looped around pulleys 13, 14 rotatably fixed to both ends of a horizontal table 12. All the endless belts 15~18 are supported on the horizontal table 12 in contact therewith and driven by a motor 19 so that they can intermittently advance at a prescribed constant interval. As shown in FIG. 1, the two inner belts 16, 17 are disposed at such interval that the crease lines 5, 6 of the unfolded dressing paper are placed on them; the two outer belts 15, 18 are disposed at an interval so that they can support the inner-flap part 3 and the front cover part 4 respectively. Every belt has a number of perforations 20 spaced at a certain interval in the longitudinal direction. Likewise, a number of slits 22 are provided to the horizontal table 12; in addition, a suction box 21 is provided under it. Therefore, when the perforations 20 of the endless belts pass by on the slits 22 on the horizontal table 12, the perforations coincide with the slits and thereby there appears enough suction to keep the dressing paper still stay on the belts. In consequence, once the dressing paper 1 is put on the conveyor belts 15~18, the suction firmly holds it, preventing from getting out of the prescribed position during its intermittent travel on the belts.

Figure 3:
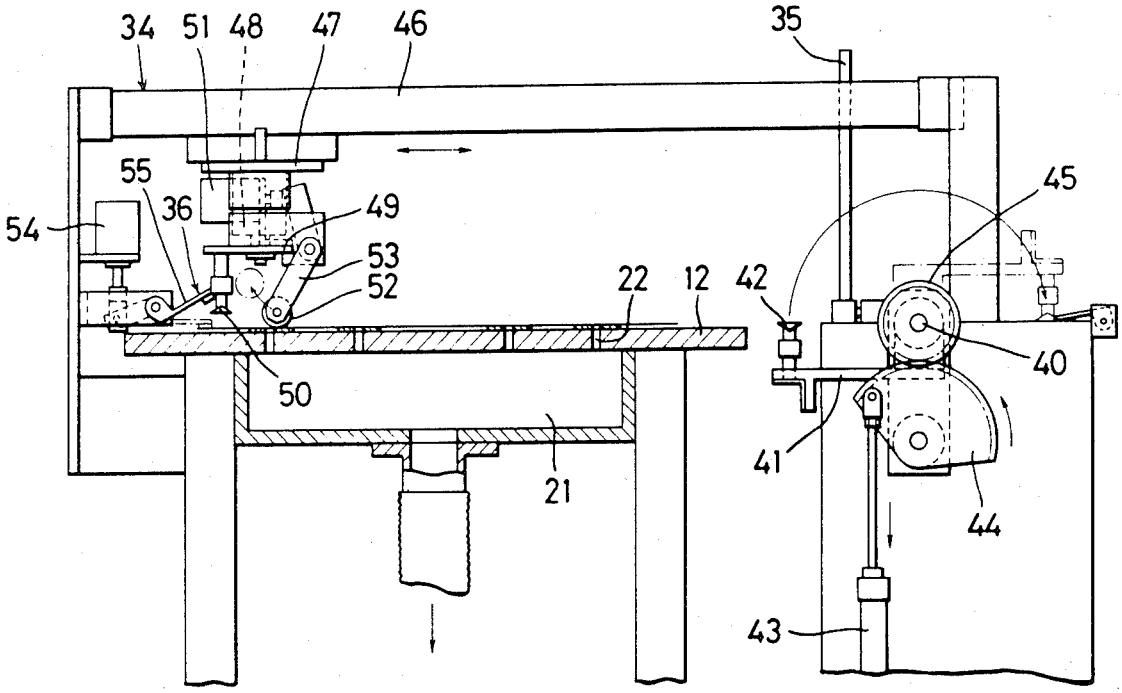
FIG. 3 is a longitudinal cross-sectional view of the apparatus taken on line A—A in FIG. 1.

As shown in FIGS. 3 and 4, the dressing paper-feeding apparatus 31 is constructed of a depository 32 to hold a pile of the triple-folded dressing paper in, a sucker 33 to attract and unfold the inner-flap part 3 of the uppermost dressing paper with, a feeder 34 to feed the dressing paper on to the conveyor 11 with the aid of suction, a bar 35 to unfold the front cover part 4 of the dressing paper being fed with, and a holder 36 to temporarily hold the dressing paper at a prescribed position on the conveyor 11 with.

Provided to the depository 32 is a lift 37 to put a pile of the dressing paper on, which can ascend and descend by means of a threaded shaft 39 driven by a motor 38. A limit switch disposed immediately above the lift 37 always locates the uppermost dressing paper with exactness and keeps its height constant by driving the motor 38 ~~so as~~ to raise the lift 37 as much every time a sheet of the dressing paper has been taken out.

Meanwhile, in the depository 32, the dressing paper is piled up on the lift 37, each folded in three with the inner-flap part 3 laid on the front cover part 4 and oriented in such a way that the developing direction of the inner-flap part 3 is in line with the longitudinal direction of the conveyor 11.

As shown in FIGS. 3 and 4, the sucker 33, constructed essentially of an L-shaped arm 41 provided with a plurality of sucking disks 42, can swing around a shaft 40 by 180° from top of the dressing paper pile 1 on the lift 37 to the position shown by a solid line in FIG. 3, along with the extension and contraction of a cylinder 43 that rotates a fan-shaped gearwheel 44 coupled with a gearwheel 45, which rotates the shaft 40. The sucker 33 firmly holds a sheet of the dressing paper on top by the inner flap part by means of the suction thereof when put on the paper pile and puts it on the horizontal table 12 upside down.

Figure 9:
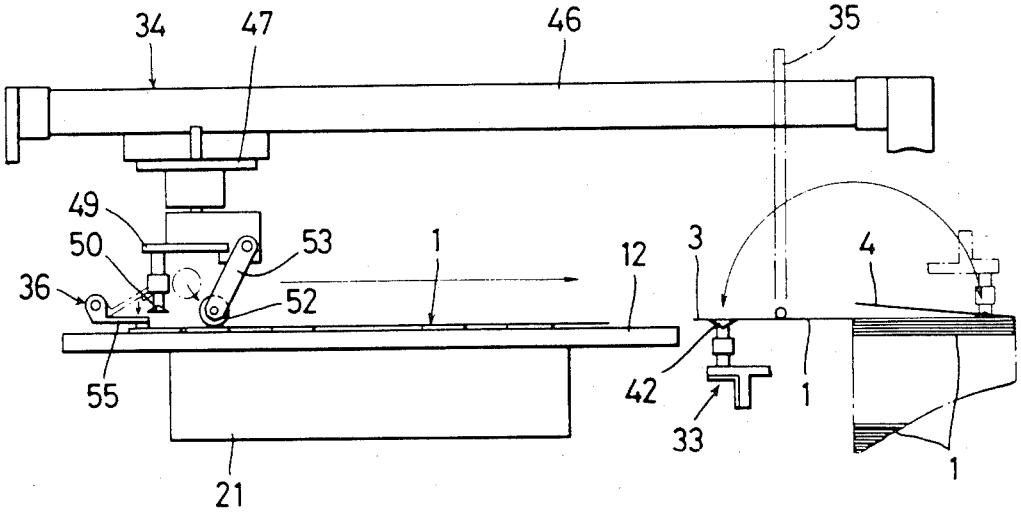
FIGS. 9A and 9B are an illustration showing the action of a dressing paper-feeding mechanism.
Figure 9:
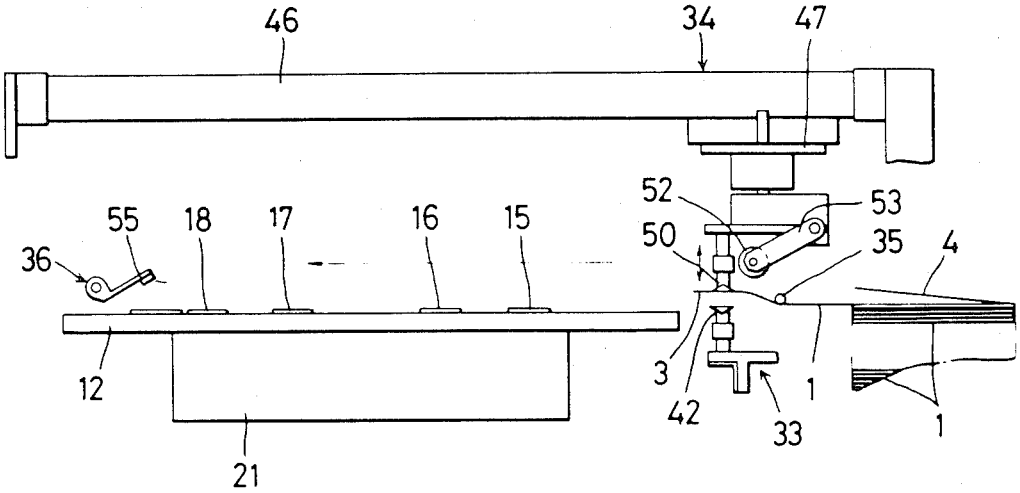

Again, as shown in FIGS. 9A and 9B, the feeder 34 is constructed in such a way that a rodless cylinder 46, disposed over the conveyor at right angles thereto, can longitudinally move an upper plate 47 on the undersurface thereof, a cylinder 48, provided under the upper plate 47, can lift or lower a lower plate 49 whose undersurface is provided with a sucking disk 50 and a cylinder 51 can swing an arm 53 whose upper end can swivellably be fixed to an end of the lower plate 49 nearer to the depository 32 and whose lower end is provided with a roller 52.

The feeder draws near the depository 32 when the sucking disk 50 is lifted and the roller 52 is lowered, and there the feeder 34 lowers the sucking disk 50 down to the inner flap part 3 of the dressing paper 1 placed on the horizontal table 12, holds it up by the inner flap part having already been released from the hold of the sucking disks 42, and feeds it on to top of the conveyor 11. Meanwhile, when the feeder 34 goes backward away from the depository 32, the cylinder 51 extends so as to lower the roller 52, whereby the roller can roll on the dressing paper so that it is pressed on the horizontal table 12 so well as to be sucked through the perforations 20 on the endless belts 15~18.

The holder 36, disposed on the horizontal table 12 on the opposite side of the depository 32, is constructed of a claw 55 movable up and down by a cylinder 54, which firmly presses the inner flap part 3 of the dressing paper 1 on the horizontal table 12 for a while and prevents it from being got out of the given position by the roller 52. The bar 35, swingably fixed with a shaft 56 on the opposite side of the sucker 33 outside the depository 32 so as to stand upright or lie down centering around the shaft 56 by a cylinder 57, is laid on the dressing paper being fed on to the conveyor 11 and then gets in the crease line 6 between the front cover part 4 and the back cover part 2 in order to raise and unfold the front cover part 4. The unfolded dressing paper 1 stops at the position II and III, but nothing is made on it there. As shown in FIG. 1, the slits for holding the inner flap part 3 are not provided there and onward in order to facilitate the bending-up of the dressing paper on the crease line 5.

The first dressing paper-bending up member 61 is constructed of a triangular plate fixed immediately under where the inner flap part passes by between the position III and IV. That is, the inner flap part 3 is bent up by a certain angle to the horizontal plane on the crease line 5 when getting on the triangular plate by itself on the way to the position IV.

The hose-feeding apparatus 71 and the first dressing paper-folding member 81 are disposed on one side of the conveyor 11 so as to cope with the dressing paper that stops at the position IV, whereas the hose-feeding member 91 is disposed above the conveyor 11 so as to be able to fold hose on the spot.

Figure 5:
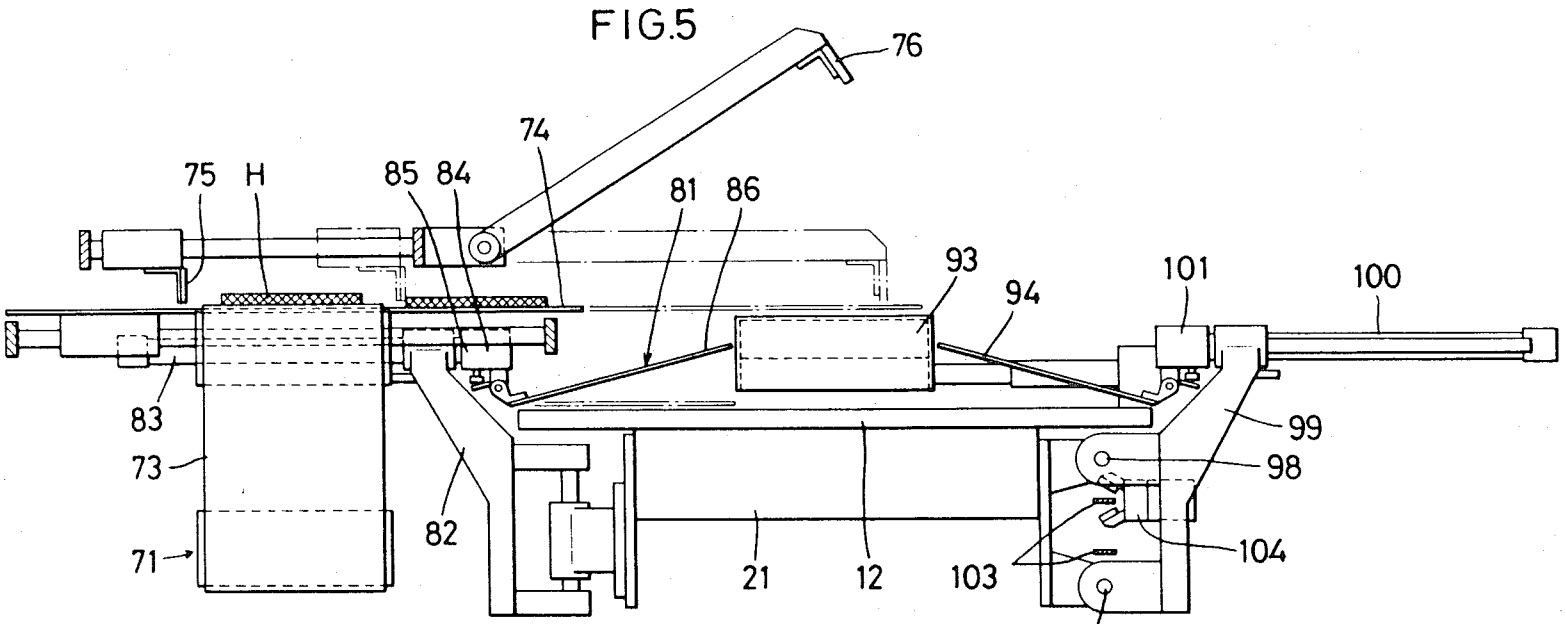
FIG. 5 is a longitudinal cross-sectional view of the apparatus taken on line C—C in FIG. 1.

As shown in FIGS. 1, 2 and 5, the hose-feeding apparatus 71 jointly works with a hose-taking off apparatus provided to a hose-finishing apparatus, for example. A conveyor 72 for carrying hose taken off from a pattern plate of a hose-finishing apparatus and a conveyor 73 for carrying them to the hose-feeding apparatus upon receipt, which is horizontally disposed just under the terminal of the conveyor 72, are disposed on the same side of the horizontal table 12 as is the hose-feeding apparatus, in order that the top of the conveyor 73 may be a little higher than the top of the horizontal table. The layout being such that, as shown in FIG. 1, it is possible that the lateral center line of hose H, perpendicular to the longitudinal direction of the conveyor 11, coincide with the center line of the dressing paper 1, perpendicular to the crease lines, at the position IV by the locating of a sensor.

Disposed beneath the upper half of the loop of the conveyor or belt 73 is a horizontal receiving plate 74 forwardly and backwardly movable on the dressing paper 1 at the position IV by a cylinder (not shown here); moreover, disposed above the conveyor 73 is a transfer plate 75, which can move over across the conveyor belt 73. A weighting member at the position IV is able to be raised and laid on top of a turnover plate 92 and a fixed plate 93 by a cylinder (not shown here). The transfer plate 75 forwards a pair of hose to the top of the horizontal receiving plate 74 every time it makes a stroke of certain distance. When the hose are put on the receiving plate 74, it forwards them again on to the turnover plate 92 and the fixed plate 93. The weighting plate is next lowered from a position shown by a solid line to a position shown by a chain line in FIG. 5 in order to press the hose down on the turnover plate 92 and the fixed plate 93 so that the hose cannot move while the receiving plate 74 goes backward.

When the weighting member 76 is lifted to the original position, the hose are lowered and fed on to the dressing paper 1 so that the center line of the hose is placed on the center line of the back cover part 2.

The first dressing paper-folding member 81 is located under the receiving plate 74, as shown in FIGS. 1 and 5. A cylinder 83 is horizontally provided to a supporting bracket 82 fixed to the side of the horizontal table 12; a cylinder 85 is provided to a supporting bracket 84 fixed to the top of a piston rod of the cylinder 83. The structure being such that, in the retired position, a comb-shaped weighting plate 86, rotatably fixed to the supporting bracket 84, is raised by the cylinder 86, as shown by a chain line in FIG. 5. The plate 86 goes forward as is raised and lays the inner flap part 3 of the dressing paper, previously bent up, on the hose. In the advanced position, it is horizontally lowered down to the inner flap part 3 to press and fold the hose H. When returning to the retired position, it is held horizontally.

The hose-folding member 91, disposed above the conveyor 11, is constructed of the turnover plate 92, disposed behind the dressing paper 1 having been forwarded to the position IV, the fixed plate 93, disposed ahead of the same dressing paper, and a comb-shaped weighting plate 94, capable of getting close to and away from the dressing paper and following its traveling from the position IV to V. The turnover plate 92 is designed to rotate clockwise and counterclockwise by about 180°, from on top of the dressing paper stationed at the position III to on top of the back cover part 2 thereof stationed at the position IV, by means of a shaft 96 of a motor 95 supported on the horizontal table 12.

The fixed plate 93, located above the position V, leaves a narrow interstice on top of the horizontal table 12, through which overlapped dressing paper and hose H are allowed to pass. At the moment the hose H are fed on the dressing paper 1 at the position IV, one $H_1$ of their ends is placed on the turnover plate 92 and the other $H_2$ is placed on the fixed plate 93.

As shown in FIGS. 2, 5, 6 and 7, a bracket 99 is slidably fitted on a guide shaft 98 provided to one side of the horizontal table 12 parallel to the conveyor belts; another bracket 101 receives a piston rod of a cylinder 100 fixed to the bracket 99. Moreover, a comb-shaped weighting plate 94, swivelably fixed to the bracket 101, can freely be raised and laid flat on the horizontal table 12 by a cylinder 102 joined to the bracket 101.

An endless belt 103, disposed parallel to the guide shaft 98, moves in association with the belts 15~18 of the conveyor 11 as shown in FIG. 2; additionally, a gripper 104 for holding the belt 103 is provided to the slidable bracket 99 in order to move the comb-shaped weighting plate 94 from the position IV to V. The slidable bracket 99 is connected to a plate 105, fixed to the side of the horizontal table 12, with a spring 106, so that when the gripper 104 releases its hold on the endless belt 103 before the weighting plate 94 is about to reach the position V, the weighting plate 94 returns by itself to the position IV by the contraction of the spring 106. The shock the slidable bracket 99 is to receive when returning to the position IV is absorbed by an air-cylinder 107 provided to the fixed plate 105; at the same time, the correct positioning of the slidable bracket is made in a moment.

Figure 7:
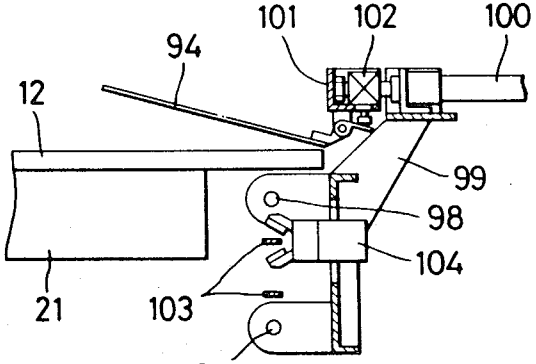
FIG. 7 is a cross-sectional view of the apparatus taken on line E—E in FIG. 2.
Figure 6:
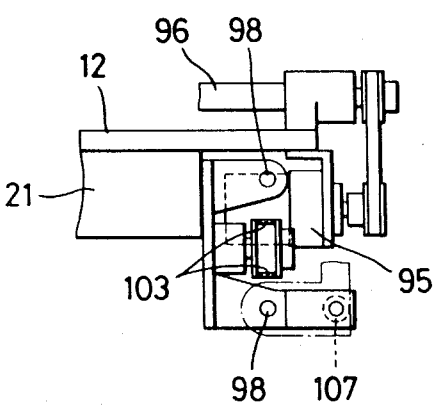
FIG. 6 is a cross-sectional view of the apparatus taken on line D—D in FIG. 2.

The weighting plate 94, as shown by a solid line in FIG. 7, is swibellably raised at its retired position correspondent to the position IV. It goes forward as is raised and stops immediately above the back cover part 2 of the dressing paper 1 after one $H_1$ of the hose ends having been folded by the turnover plate 92, where it is laid on the hose H and the dressing paper 1 so as to press them together on the horizontal table 12. The air-cylinder 107 moves the slidable bracket 99 a little toward the position V at this moment in order to pull the end $H_1$ of the holded hose so as not to leave slackening thereon. After that, the gripper gets actuated to hold the belt 103; thus, the weighting plate 94 goes to the position V in order to forward the hose H and the dressing paper 1 in one altogether. On the way of the weighting plate 94 to the position V from IV, the other end $H_2$ of the hose H is pulled in under the fixed plate 93, whereby the second end $H_2$ is automatically put on the first end $H_1$ already folded.

The slits 22 for sucking the front cover part 4 are no longer provided between the position IV and V, as shown in FIG. 1; in addition, the second dressing paper-bending up member 110 with a triangular shape is provided immediately under where the front cover part 4 passes by; therefore, the front cover part 4 is bent up by a given angle by it.

The second dressing paper-folding member 111, disposed in correspondence with the position VI, is constructed of a cylinder 112, a supporting bracket 113, a cylinder 114 and a horizontal weighting plate 115, wherein the cylinder 112 serves to lift or lower the bracket 113 whose upper end is provided with the horizontal cylinder 114 whose piston rod end is provided with the weighting plate 115. Therefore, the weighting plate 115 lays the front cover 4 on the hose in the progress of going forward and press them down together in the progress of lowering. Thus, the dressing paper 1 wrapping up the hose H is folded in three in the end.

After the weighting plate being removed, the dressing paper thus folded in three is forwarded to the position VII by means of the endless belts 16, 17, while the front cover part 4 thereof is being pressed down by a guide plate 121 so as not to stand up released.

Figure 8:
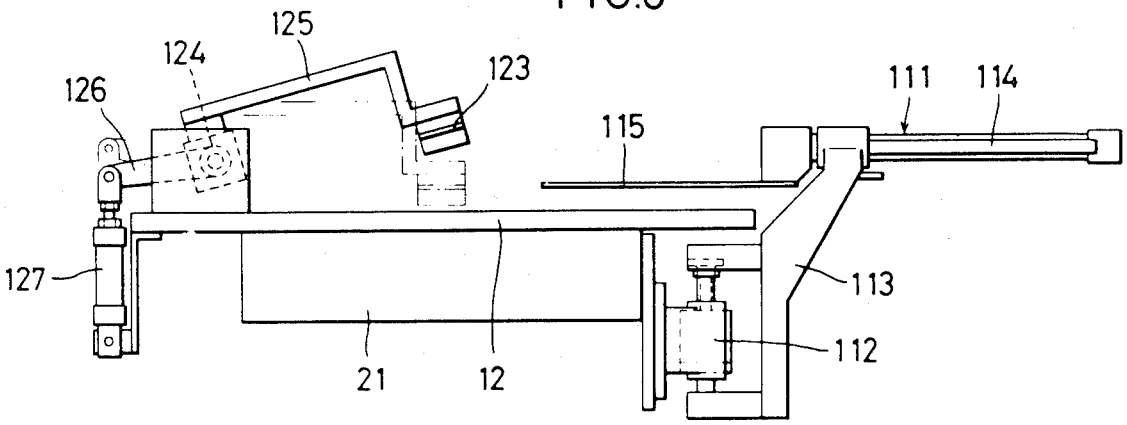
FIG. 8 is a cross-sectional view of the apparatus taken on line F—F in FIG. 1.

Disposed above the position VII is an inserting plate 123, which serves to insert the hose H wrapped up in the dressing paper 1 into the envelope 7 stored in the packing apparatus disposed ahead. As shown in FIGS. 1 and 8, the inserting plate 123 is fixed to an arm 125 provided to a rodless cylinder 124, disposed parallel to the conveyor 11, and the arm is connected to a link 126 of a cylindre 127 provided to the side of the horizontal table 12. Therefore, the inserting plate 123 is swung up and down by the contraction and extension of the cylinder 127 by way of the arm 125 and the link 126. The inserting plate 123, as shown by a solid line in FIG. 8, is lowered, in the retired position, in order to press the dressing paper 1 stationed at the position VII and takes it to the advanced position, as shown by a chain line in FIG. 1, in order to pack it into the envelope 7.

The packing apparatus 131 is located ahead of the inserting plate 123 on the conveyor 11, as shown in FIG. 1. It is always on standby provided with a lot of envelopes 7, whose mouth is opened as a sucking disc 133 sucks and holds up one side thereof and kept open by the insertion of a couple of claws 132. After the dressing paper 1 having been put in the envelope 7 by the inserting plate 123, the claws 132 are withdrawn therefrom together with the inserting plate 123 and the packed envelope 7 is taken out forward.

As the structure of the hose-folding and -packing apparatus has been described, the action thereof will be explained in detail mainly in reference with FIGS. 10A~C, 11A~C, 12A~C and 13A and B. As the dressing paper 1, each folded in three and piled up in the depository 32, is fed on to the position I on the conveyor 11 unfolded by the dressing paper feeding apparatus 31, the endless belts 15~18 of the conveyor 11 firmly hold it by suction. Along with the actuation of the motor 19, the group of the endless belts start moving intermittently. That is, each time the dressing paper 1 is fed onto the position I, it is intermittently forwarded one pitch by one pitch which distance is substantially equal to the breadth of the dressing paper.

Figure 10:
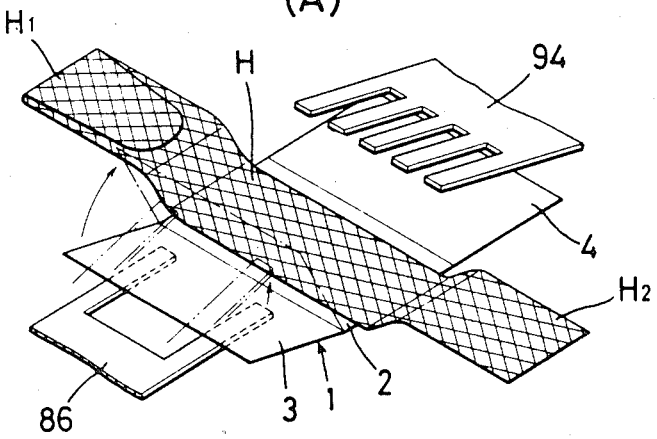
FIGS. 10A to 10C are an illustration showing a pair of hose put on a sheet of dressing paper.
Figure 10:
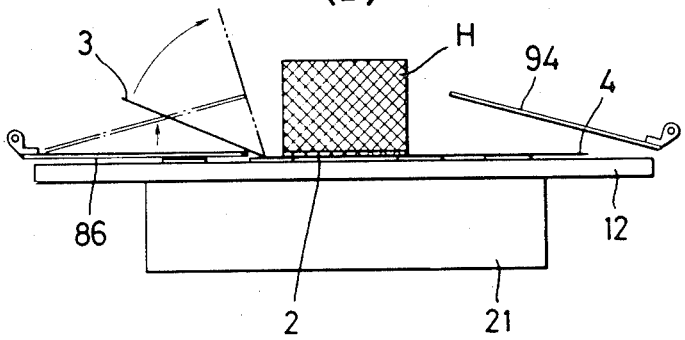
Figure 10:
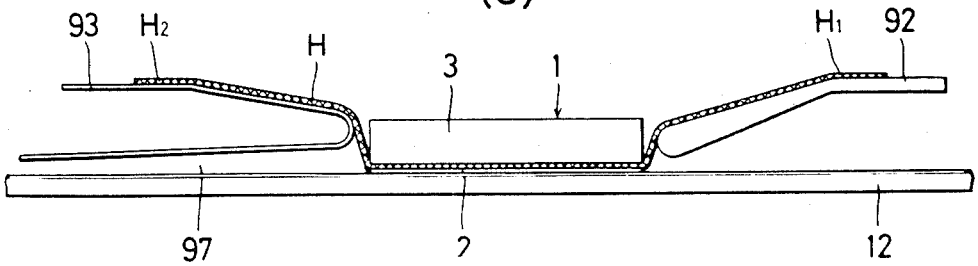

In the progress of being forwarded, the inner flap part 3 of the dressing paper 1 is bent upward in the middle of traveling between the position III and IV by the first dressing paper-bending up member 61. When the dressing paper stops at the position IV, a pair of hose are fed onto the back cover part 2 thereof from the hose-feeding apparatus 71. At the moment, both ends $H_1$, $H_2$ of the hose H are placed on the turnover plate 92 and the fixed plate 93 respectively, as shown in FIGS. 10A and C. No sooner are the hose placed on the dressing paper than the comb-shaped weighting plate 86 of the first dressing paper-folding member 81 goes forward as is raised as shown in FIGS. 11A and B and lies down at its advanced position so as to lay the inner flap part 3 of the dressing paper 1 on the hose H.

Figure 11:
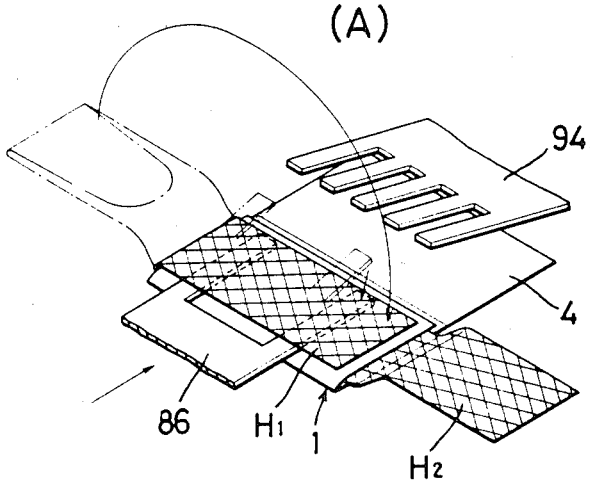
FIGS. 11A to 11C are an illustration showing one of the hose ends is folded on the inner-flap part of the dressing paper.
Figure 11:
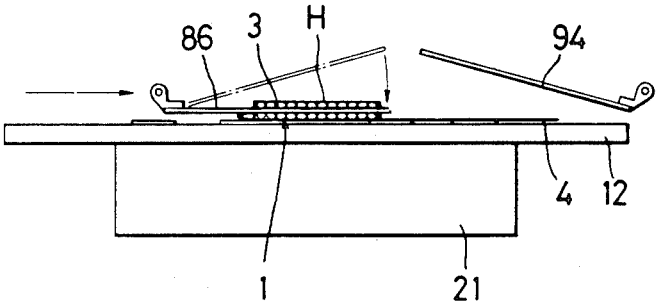
Figure 11:
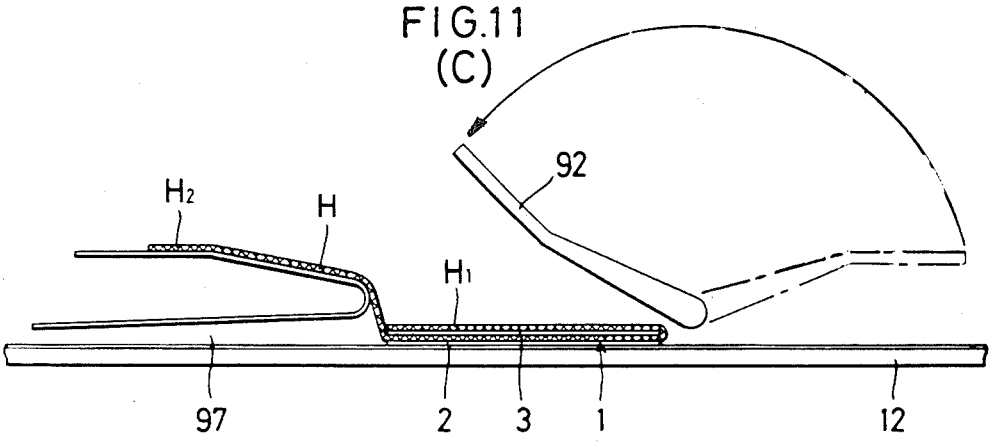
Figure 12:
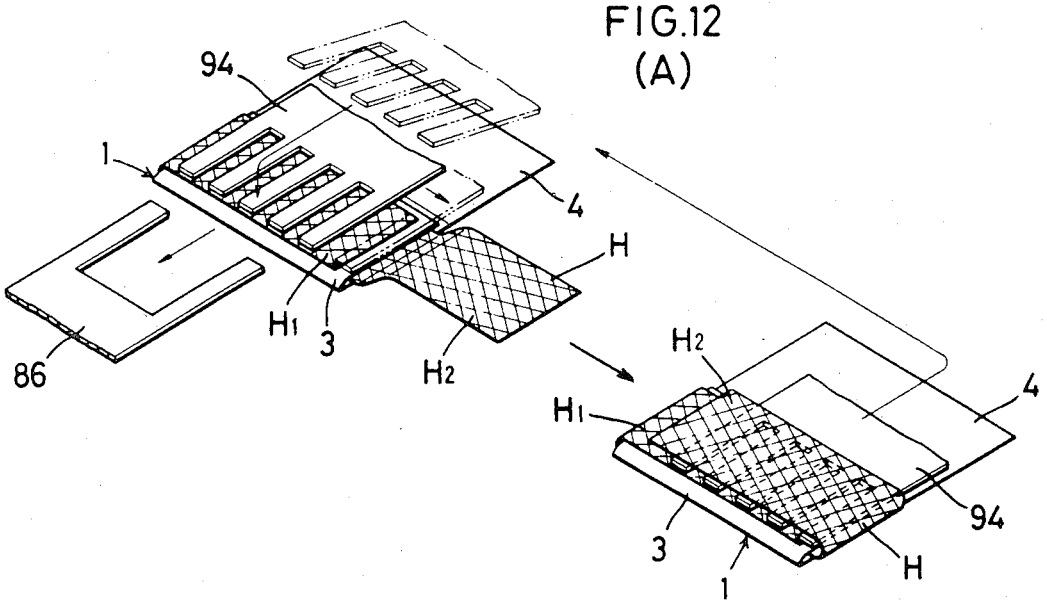
FIGS. 12A to 12C are an illustration showing the other of the hose ends is being folded on the first one already folded on the dressing paper.
Figure 12:
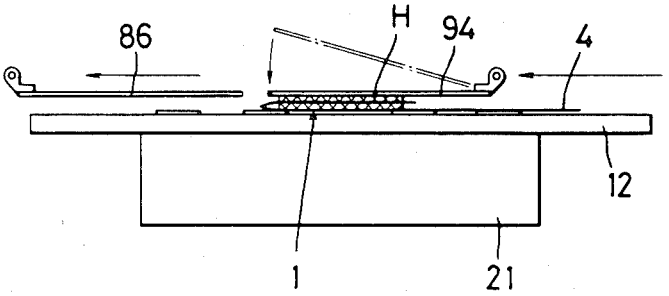
Figure 12:
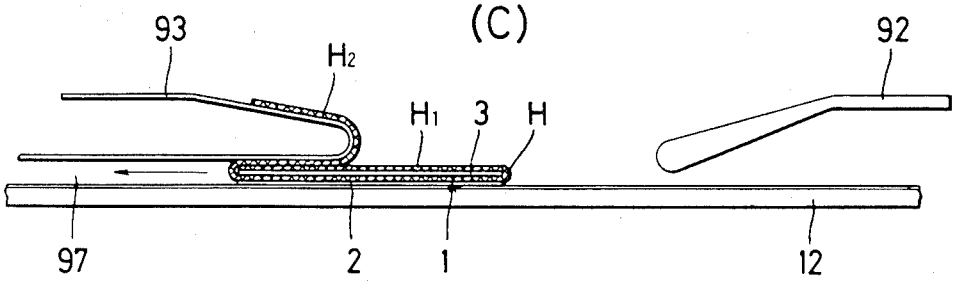

Next, the turnover plate 92, turning over the dressing paper, lays one $H_1$ of the hose ends, placed on itself, on the inner flap part 3 of the dressing paper 1, as shown in FIGS. 11B and C. As the turnover plate recedes to the waiting position, another comb-shaped weighting plate 94 proceeds as is raised and lies down on the hose end $H_1$, as shown in FIG. 12B, to press. At the moment, the weighting plate 86 of the first dressing paperfolding member 81 goes backward and get out between the hose end $H_1$ and the inner flap part 3. The weighting plate 94, after having pressed the hose end $H_1$, moves a little toward the position V in order to tense it so as not to leave slackening on the hose.

The weighting plate 94 moves to the position V, together with the dressing paper 1, passing through under the fixed plate 93, as shown in FIG. 12C, so that the hose end $H_2$ on the fixed plate is pulled in beneath the same and put on the first end $H_1$; in the end, the inner flap part 3 of the dressing paper 1 comes to be enrolled with the hose H.

This system of folding hose being such that it is very effective in order not to leave slackening over the folded hose.

When the dressing paper 1 stops at the position V, the weighting plate 94 goes backward, getting out between the hose ends $H_1$, $H_2$ and returns to the original position correspondent to the position V, as shown in FIG. 12A.

Figure 13:
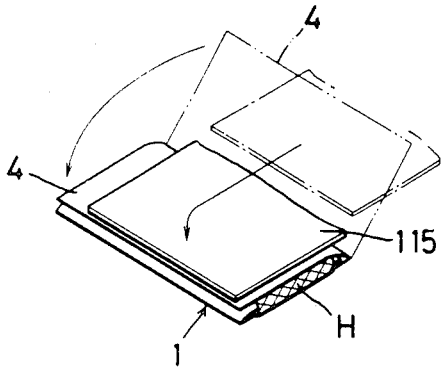
FIGS. 13A and 13B are an illustration showing the front cover part of the dressing paper is being folded.
Figure 13:
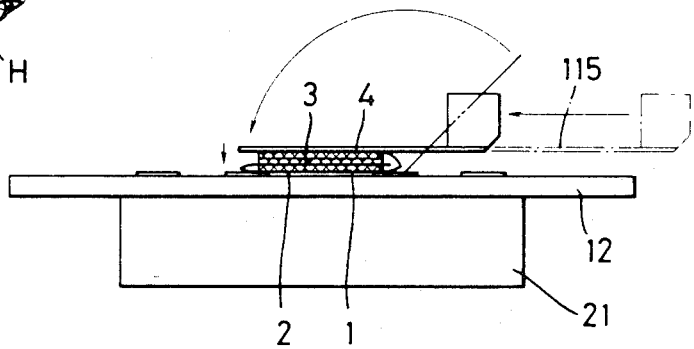
Figure 14:
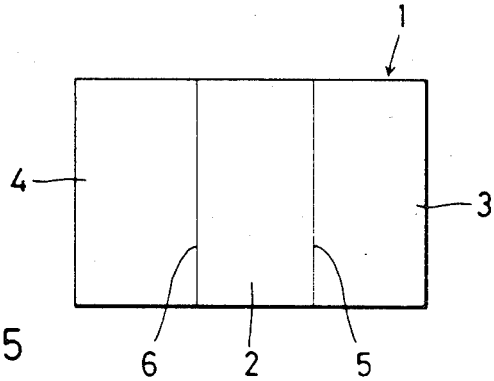
FIG. 14 is a development of the dressing paper.

On the way to the position VI from the position V, the front cover part 4 of the dressing paper is raised by means of the second dressing paper-bending up member 110. On its arrival at the position VI, the horizontal weighting plate 115 of the second dressing paper-folding member 111 goes forward and lays the front cover part 4 flat on the hose end $H_2$, as shown in FIGS. 13A and B, so that the dressing paper wraps up the hose H.

After the weighting plate 115 having bone backward, the dressing paper packed with the hose is transfered to the position VII from the position VI, where it is put in the envelope 7 disposed ahead with the aid of the inserting plate 123 and a couple of claws 132 serving to keep open the mouth of the envelope. The envelope, after being packed with the hose, is taken out of the conveyor 11 to a given position.

As stated above, according to the apparatus of this invention, hose can be folded, wrapped up in the dressing paper and put in the envelope very correctly in a continuous manner at a prescribed time interval.

We claim:

1. A process for folding and packing hose, which comprises a dressing paper-folding sub-process, wherein a sheet of dressing paper consisting of three parts, to form front cover part, to form back cover part and to form inner flap part, capable of being folded in three on two crease lines previously provided, is fed, in the developed condition, on to a conveyor belt with suction power by which said dressing paper is held and intermittently forwarded, a first dressing paper-bending up sub-process, wherein said inner flap part of said dressing paper is bent up by a given angle to the horizontal plane in the middle of the travel thereof on said conveyor belt, a hose-feeding sub-process, wherein a pair of hose are fed on to said back cover part of said dressing paper so that the longitudinal direction of said hose is in line with the moving direction of said conveyor, a first dressing paper-folding sub-process, wherein said bent-up inner flap part is laid flat on said fed hose, a hose-folding sub-process, wherein both hose ends extending out of said inner flap part are folded on said inner flap part of said dressing paper one after another so that they are overlapped with each other, a second dressing paper-bending up sub-process, wherein said front cover part of said dressing paper is bent up by a given angle to the horizontal plane in the middle of travel thereof on said conveyor belt, a second dressing paper-folding sub-process, wherein said bent-up front cover part is laid flat on said folded hose so that said hose are wrapped up in said triple-folded dressing paper, and a packing sub-process, wherein said dressing paper wrapped with said hose is put in an envelope awaiting ahead and said envelope is subsequently taken out of said moving conveyor.

2. An apparatus for folding and packing hose, which comprises, in the following order, a conveyor, constructed of an endless belt provided with a good number of perforations and a suction box disposed under an upper half of said endless belt loop, for intermittently forwarding sheets of dressing paper each consisting of three parts, to form front cover part, to form back cover part and to form inner flap part, capable of being folded in three on two crease lines previously provided, holding by the suction of said suction box with which said perforations communicate, a dressing paper-feeding apparatus for feeding said dressing paper on to a given position at one end of said conveyor, one sheet by one sheet in the developed condition, from a depository in which said dressing paper is stored, piled up, each folded in three, a first dressing paper-bending up member for bending up said inner flap part of said dressing paper in the progress of moving, a hose-feeding apparatus for feeding pairs of hose on to said back cover part of said dressing paper one by one so that the central part of said hose is put on said back cover part and the longitudinal direction of said hose is in line with the moving direction of said conveyor, a first dressing paper-folding member for folding said bent-up inner flap part flat on top of said hose, a hose-folding apparatus for folding both hose ends extending out of said inner flap part over the same one after another by the use of a turnover plate, a fixed plate and a weighting plate, wherein said turnover plate, serving to lay one end of said hose on said inner flap part, is located parallel to the moving direction of said conveyor, and said fixed plate is located similarly parallel to the moving direction of said conveyor in such a way that said hose whose one end is pressed on said inner flap part with said weighting plate are allowed to pass through beneath said fixed plate in order to lay the other on said first hose end, a second dressing paper-bending up member for bending up said front cover part of said dressing paper in the progress of moving, a second dressing paper-folding member for folding said bent-up front cover part flat on top of said hose ends folded, and a packing apparatus, capable of taking out and feeding an envelope on to a given position on said conveyor, for packing said hose wrapped up in said dressing paper into said envelope.

* * * * *